US005603662A

United States Patent [19]

Kreaman-Stern

[11] Patent Number: 5,603,662

[45] Date of Patent: Feb. 18, 1997

[54] HEMISPHERICAL ROCKING TOY

[76] Inventor: Janet E. Kreaman-Stern, 316 Viewridge Dr., Port Angeles, Wash. 98362

[21] Appl. No.: 494,401

[22] Filed: Jun. 26, 1995

[51] Int. Cl.[6] ..... A63G 1/12

[52] U.S. Cl. ..... 472/25; 472/40; 472/102

[58] Field of Search ..... 472/14, 25, 95, 472/102, 40, 41, 135, 129, 28; 297/245; 114/362, 345, 346; 441/35

[56] References Cited

U.S. PATENT DOCUMENTS 3,041,070 6/1962 Kerstein ..... 472/25

3,380,735 4/1968 Rigby ..... 472/135 X 3,586,321 6/1971 Gehrke ..... 472/14 X 4,696,251 9/1987 Spieldiener et al. ..... 114/345 X

*Primary Examiner*—Kien T. Nguyen

[57] ABSTRACT

A hemispherical rocking toy for children is disclosed. The hemispherical shell is fabricated of a rigid plastic material and includes an interior surface and an exterior surface with an open top for the receipt of children therein. The shell comprises a greater thickness in its lower extent than its upper extent to provide an annular seating surface in a horizontal plane. A pair of planar sheets is fabricated of a plastic material, each having an upper linear edge and a lower semi-circular edge and a horizontal planar edge therebetween. The lower circular edge is adapted to be received in contact with the interior surface of the shell.

3 Claims, 4 Drawing Sheets

FIG 7
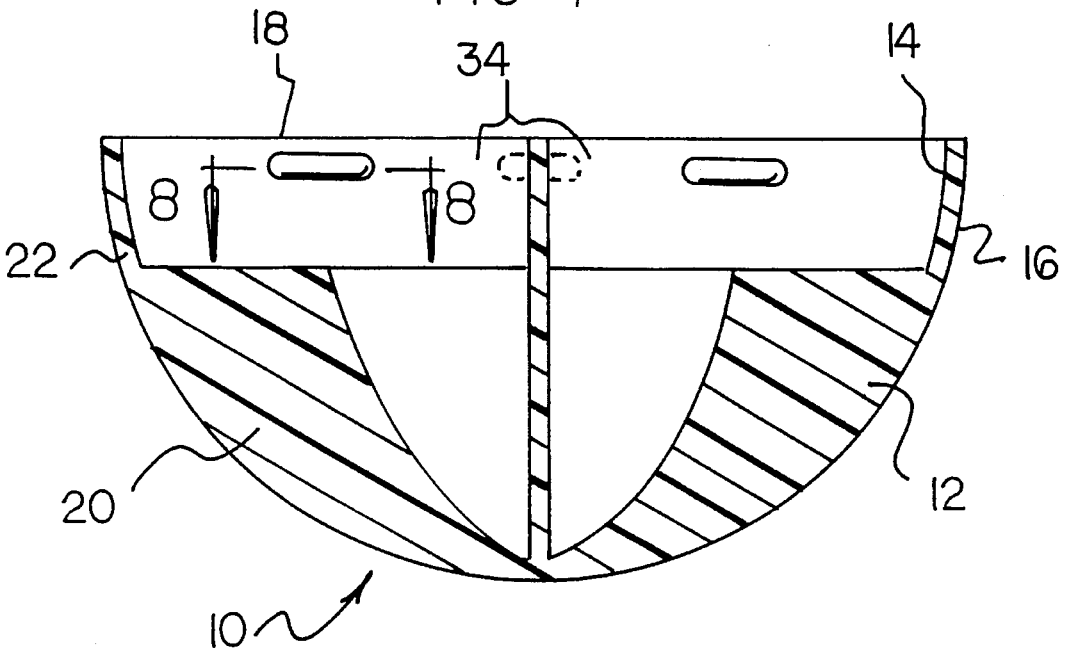
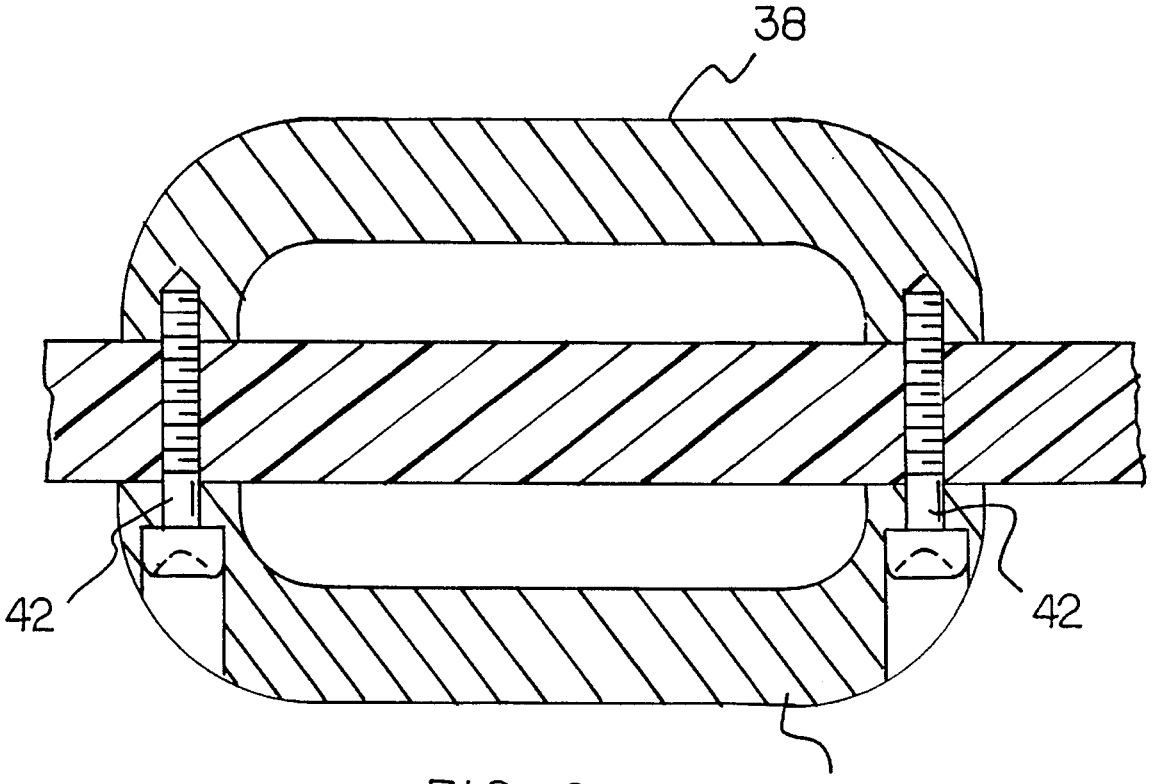
FIG 8

HEMISPHERICAL ROCKING TOY

BACKGROUND OF THE INVENTION

1. Field of the Invention

The present invention relates to a new and improved hemispherical rocking toy and, more particularly, pertains to providing entertainment and exercise for a child through a safe rocking toy of a simplified construction.

2. Description of the Prior Art

The use of toys capable of rocking children constructed of a wide variety of designs and configurations is known in the prior art. More specifically, toys capable of rocking children constructed of a wide variety of designs and configurations heretofore devised and utilized for the purpose of providing exercise and/or entertainment for children through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for providing entertainment and exercise for a child through a safe rocking toy of a simplified construction. By way of example, U.S. Pat. No. 4,193,592 to Bishow discloses a rocking, turning toy upon which the user can sit, stand or kneel.

U.S. Pat. No. 4,298,196 to Silver discloses a rocking toy capable of being ridden and rocked which is assembled from a plurality of three-dimensional modules.

U.S. Pat. No. 4,364,579 to Fisher discloses a rock and roll recreational toy with an annular body and gripping bar.

U.S. Pat. No. 4,874,163 to Chiavetta et al. discloses a rocking toy with an animal-shaped body.

U.S. Pat. No. Des. 243,545 to Seegers, Sr. discloses a rocking toy with rockers.

Lastly, U.S. Pat. No. Des. 331,430 to Nolan discloses a child's rocking and rotating riding toy.

In this respect, the hemispherical rocking toy according to the present invention substantially departs from the conventional concepts and designs of the prior art, and in doing so provides an apparatus primarily developed for the purpose of providing entertainment and exercise for a child through a safe rocking toy of a simplified construction.

Therefore, it can be appreciated that there exists a continuing need for a new and improved hemispherical rocking toy which can be used for providing entertainment and exercise for a child through a safe rocking toy of a simplified construction. In this regard, the present invention substantially fulfills this need.

SUMMARY OF THE INVENTION

In view of the foregoing disadvantages inherent in the known types of toys capable of rocking children constructed of a wide variety of designs and configurations now present in the prior art, the present invention provides an improved hemispherical rocking toy. As such, the general purpose of the present invention, which will be described subsequently in greater detail, is to provide a new and improved hemispherical rocking toy and methods which have all the advantages of the prior art and none of the disadvantages.

To attain this, the present invention essentially comprises a new and improved hemispherical rocking toy for children comprising, in combination, a hemispherical shell fabricated of a rigid plastic material, the hemispherical shell including an interior surface and an exterior surface with an open top for the receipt of children therein, the shell being of a greater thickness in its lower extent than its upper extent to provide an annular seating surface in a horizontal plane; a pair of planar sheets fabricated of a plastic material each having an upper linear edge and a lower semi-circular edge and a horizontal planar edge therebetween, the lower circular edge adapted to be received in contact with the interior surface of the shell, the plates adapted to divide the interior of the shell into four equal sized and configured areas each for the receipt of a child; a pair of handles in a U-shaped configuration located on each plate at locations in proximity to the upper edge of the planar plates, each for being held by a child while sitting on the planar surface of the shell to facilitate rocking thereof; and bolts extending through adjacent handles to couple handles together on opposite sides of each plate.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hemispherical rocking toy which has all the advantages of the prior art toys capable of rocking children constructed of a wide variety of designs and configurations and none of the disadvantages.

It is another object of the present invention to provide a new and improved hemispherical rocking toy which may be easily and efficiently manufactured and marketed.

It is a further object of the present invention to provide a new and improved hemispherical rocking toy which is of a durable and reliable construction.

An even further object of the present invention is to provide a new and improved hemispherical rocking toy which is susceptible of a low cost of manufacture with regard to both materials and labor, and which accordingly is then susceptible of low prices of sale to the consuming public, thereby making such toys capable of rocking children constructed of a wide variety of designs and configurations economically available to the buying public.

Still yet another object of the present invention is to provide a new and improved hemispherical rocking toy which provides in the apparatuses and methods of the prior art some of the advantages thereof, while simultaneously overcoming some of the disadvantages normally associated therewith.

Even still another object of the present invention is to provide entertainment and exercise for a child through a safe rocking toy of a simplified construction.

Lastly, it is an object of the present invention to provide a hemispherical rocking toy for children. The hemispherical shell is fabricated of a rigid plastic material and includes an interior surface and an exterior surface with an open top for the receipt of children therein. The shell comprises a greater thickness in its lower extent than its upper extent to provide an annular seating surface in a horizontal plane. A pair of planar sheets is fabricated of a plastic material, each having an upper linear edge and a lower semi-circular edge and a horizontal planar edge therebetween. The lower circular edge is adapted to be received in contact with the interior surface of the shell.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a cross-sectional view taken along line 7—7 of FIG. 5.

FIG. 8 is a cross-sectional view taken along line 8—8 of FIG. 7.

The same reference numerals refer to the same parts throughout the various Figures.

DESCRIPTION OF THE PREFERRED EMBODIMENT

Figure 1:
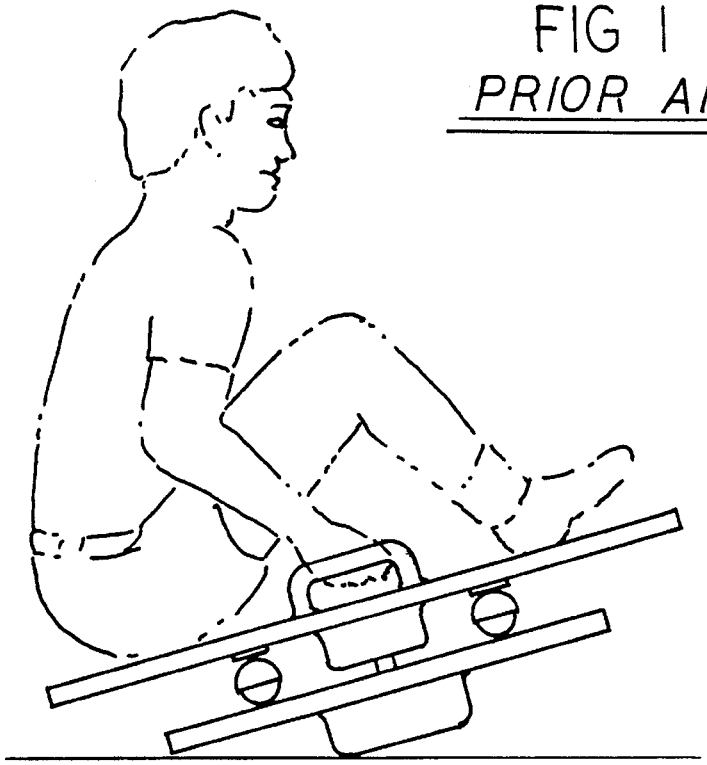
FIG 1 PRIOR ART
FIG. 1 is a side elevational view of a child's rocker toy constructed in accordance with a prior art design.
Figure 2:
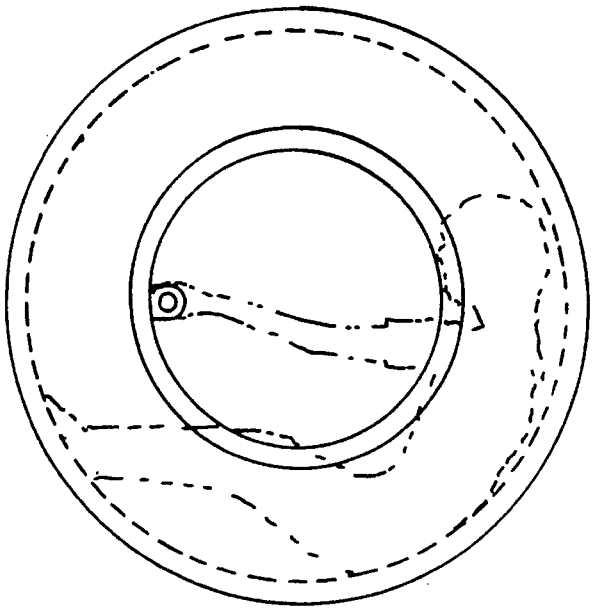
FIG 2 PRIOR ART
FIG. 2 is a top view of another prior art child's rocker toy.
Figure 3:
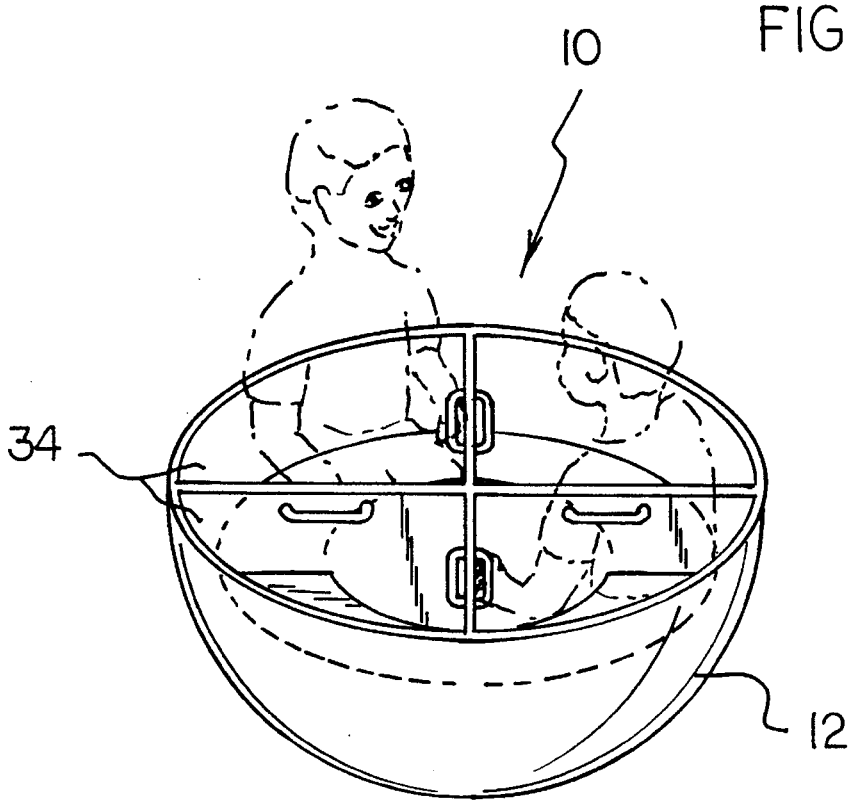
FIG. 3 is the preferred embodiment of the new and improved hemispherical rocking toy constructed in accordance with the principles of the present invention.
Figure 4:
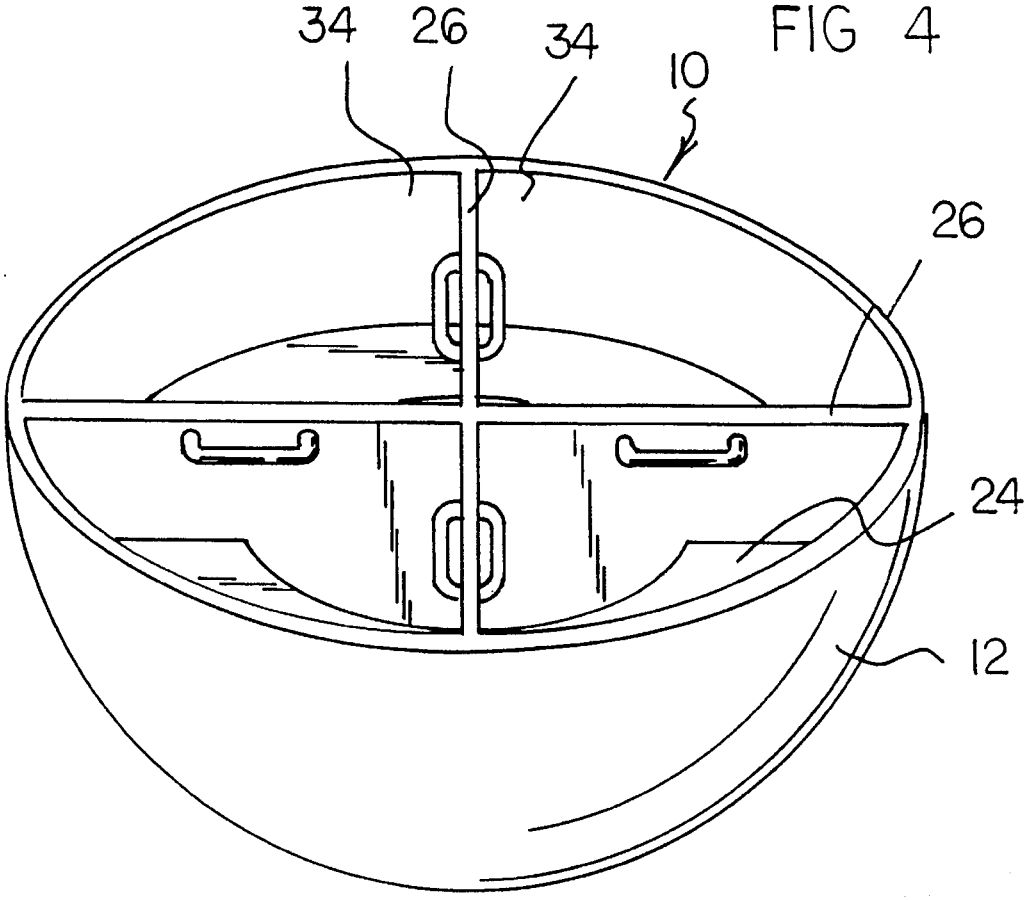
FIG. 4 is an enlarged perspective view similar to FIG. 3 but shown with the children removed.
Figure 5:
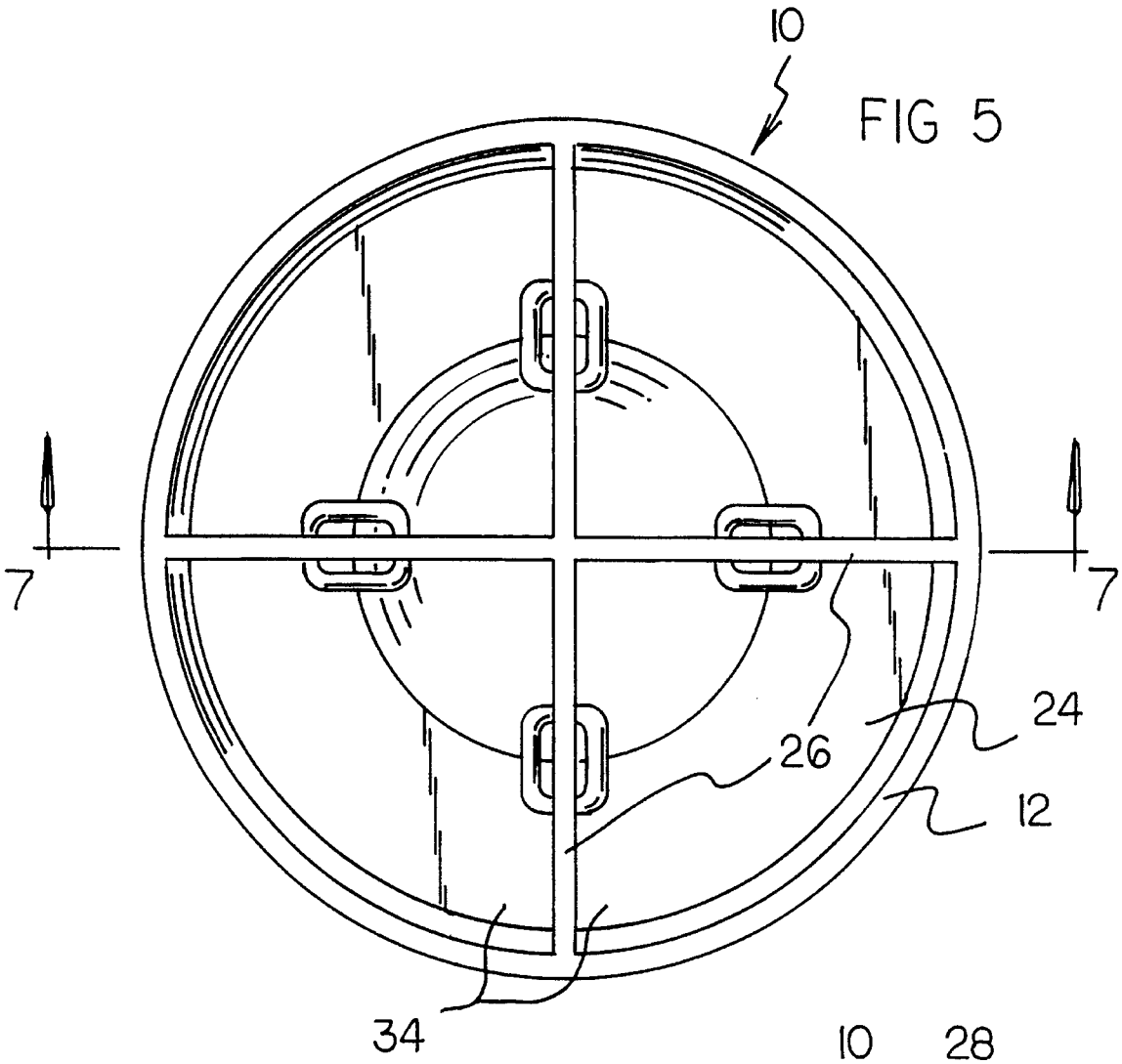
FIG. 5 is a top plan view of the device shown in FIGS. 3 and 4.
Figure 6:
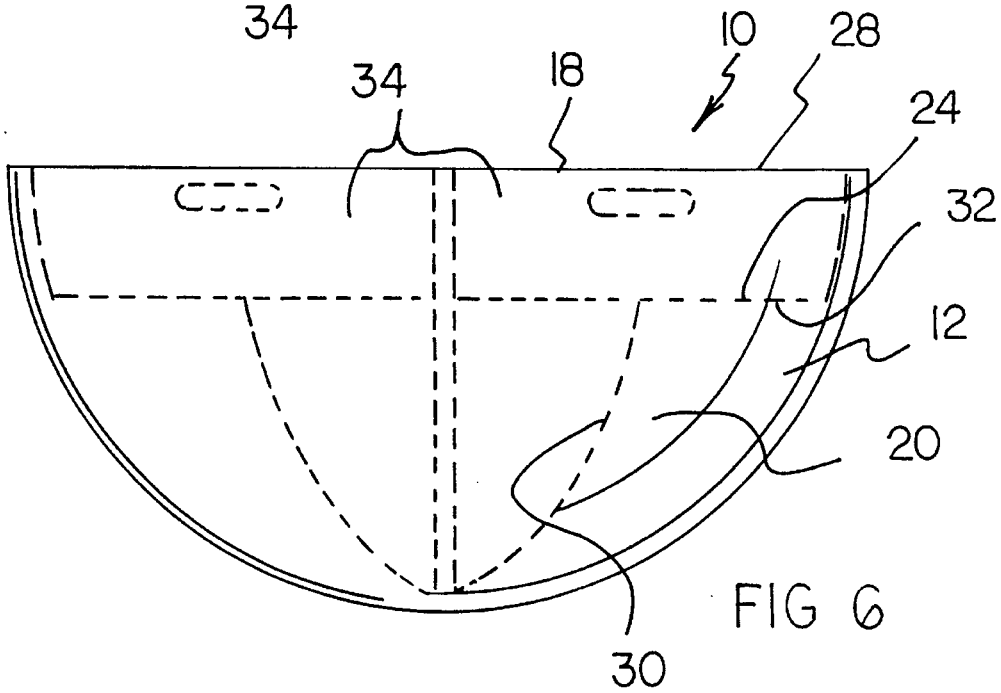
FIG. 6 is a side elevational view of the device shown in FIGS. 3, 4 and 5.

With reference now to the drawings, and in particular to FIG. 1 thereof, the preferred embodiment of the new and improved hemispherical rocking toy embodying the principles and concepts of the present invention and generally designated by the reference numeral 10 will be described.

The present invention, the new and improved hemispherical rocking toy is a system 10 comprised of a plurality of components. In their broadest context, the components include a hemispherical shell, planar sheets and handles. Each of the individual components is specifically configured and correlated one with respect to the other so as to attain the desired objectives.

More specifically, the present invention is a rocking toy 10. The principal component of the toy is a hemispherically-shaped shell 12. Such shell is fabricated of a rigid plastic material. Other materials are capable of being utilized for the fabrication of the shell and other components but a rigid plastic is preferred. Such hemispherical shell includes an interior surface 14 and an exterior surface 16. Also formed with the shell is an open top 18 for the receipt of children therein.

The exterior of the shell is a smooth hemisphere. The interior of the shell, however, is formed with a greater thickness in its lower extent 20 and with a lesser thickness in its upper extent 22. At the area of joining between the upper and lower extents is an annular seating surface 24 for the children therein. Such annular seating surface is in a horizontal plane.

The next major component of the toy 10 are a pair of planar sheets 26. Such sheets are fabricated of a rigid plastic material, preferably the same material as that of the shell. Each planar sheet has an upper linear edge 28. Each sheet also has a lower semi-circular edge 30 at its lower extent. Intermediate such edges is a horizontal planar edge 32. The lower circular edge is adapted to be received in contact with the interior surface of the shell at its lower extent. The plates function to divide the interior of the shell into four equally sized and configured areas 34. Each of such areas is for the receipt of a single child therein.

The final major component of the toy 10 is a pair of handles 38 each in a U-shaped configuration arranged in pairs on opposite sides of each plate. Each of the handles is at a location in proximity to the upper edge of the planar sheet to which it is secured. Each handle is for being held by a child while sitting on the planar surface of the shell to facilitate the rocking thereof. The handles have a central linear extent and inturned linear extents with apertures extending therethrough. The handles are arranged in pairs with unthreaded apertures extending through the end of one adjacent handle and threaded apertures extending into the adjacent handle. In association therewith, bolts 42 are provided to extend through the unthreaded apertures and to threadably couple with the threaded apertures. In this manner, adjacent sets of handles can couple together on opposite sides of each plate for simple coupling and coupling therebetween.

The present invention comprises a toy for small children to ride on that can be moved around a yard by children shifting their weight while sitting in it. It is made of hard molded plastic in one piece. The toy is shaped like a half-sphere that is divided into four equal quarter sections by panels, similar to an orange cut in half. Inside each quarter section is a molded seat with space for a child's feet in its front. The half sphere is thirty-six inches in diameter and eighteen inches deep. All of the surfaces are smooth and the edges are rounded to prevent injury to the children playing with the toy. It could be made in various colors and patterns that please children and, if desired, decorated with animal and cartoon characters.

Two or more children can play with the toy simultaneously. At least two children should play with it to enable it to perform as intended. As the children push back into their seats, shifting their body to one side and then the other, and rocking back and forth, the half-sphere sways back and forth, and slides around in the play area.

The present invention provides many hours of fun and excitement for small children. It is lightweight, compact and easily stored and transported. The plastic material is durable and should not corrode.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved hemispherical rocking toy for children comprising, in combination:

a hemispherical shell fabricated of a rigid plastic material, the hemispherical shell including an interior surface and an exterior surface with an open top for the receipt of children therein, the shell being of a greater thickness in its lower extent than its upper extent to provide an annular seating surface in a horizontal plane;

a pair of planar sheets fabricated of a plastic material each having an upper linear edge and a lower semi-circular edge and a horizontal planar edge therebetween, the lower circular edge received in contact with the interior surface of the shell, the plates dividing the interior of the shell into four equal sized and configured areas each for the receipt of a child;

a pair of handles in a U-shaped configuration located on each plate at locations in proximity to the upper edge of the planar plates, each for being held by a child while sitting on the planar surface of the shell to facilitate rocking thereof; and bolts extending through adjacent handles to couple handles together on opposite sides of each plate.

2. A hemispherical rocking toy for children comprising:

a hemispherical shell fabricated of a rigid plastic material, the hemispherical shell including an interior surface and an exterior surface with an open top for the receipt of children therein, the shell being of a greater thickness in its lower extent than its upper extent to provide an annular seating surface in a horizontal plane; and a pair of planar sheets fabricated of a plastic material each having an upper linear edge and a lower semi-circular edge and a horizontal planar edge therebetween, the lower circular edge received in contact with the interior surface of the shell.

3. The apparatus as set forth in claim 2 and further including:

a pair of handles in a U-shaped configuration located on each plate at locations in proximity to the upper edge of the planar plates, each for being held by a child while sitting on the planar surface of the shell to facilitate rocking thereof.

* * * * *